US012798843B2

(12) United States Patent
Takahashi et al.

(10) Patent No.: US 12,798,843 B2
(45) Date of Patent: Nov. 17, 2026

(54) CAP

(71) Applicant: YOSHINO KOGYOSHO CO., LTD., Tokyo (JP)

(72) Inventors: Tetsuo Takahashi, Tokyo (JP); Hiroshi Shinozaki, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 19/124,394

(22) PCT Filed: Jan. 11, 2024

(86) PCT No.: PCT/JP2024/000410
§ 371 (c)(1),
(2) Date: Apr. 25, 2025

(87) PCT Pub. No.: WO2024/154639
PCT Pub. Date: Jul. 25, 2024

(65) Prior Publication Data

US 2026/0176036 A1 Jun. 25, 2026

(30) Foreign Application Priority Data

Jan. 19, 2023 (JP) ..... 2023-006556

(51) Int. Cl.
*B65D 51/28* (2006.01)

(52) U.S. Cl.
CPC ..... *B65D 51/2871* (2013.01)

(58) Field of Classification Search
CPC ..... B65D 51/2864; B65D 51/2857; B65D 51/2807; B65D 41/62; B65D 41/04
See application file for complete search history.

(56) References Cited

U.S. PATENT DOCUMENTS 6,050,436 A * 4/2000 Bennett ..... B65D 41/3428 220/255
2012/0248129 A1 10/2012 Yoshida et al.
(Continued)

FOREIGN PATENT DOCUMENTS

CN 201592826 U * 9/2010
CN 104411597 A 3/2015
(Continued)

OTHER PUBLICATIONS

Apr. 2, 2024 International Search Report issued in International Patent Application No. PCT/JP2024/000410.
(Continued)

*Primary Examiner* — Javier A Pagan
(74) *Attorney, Agent, or Firm* — Oliff PLC

(57) ABSTRACT

The present invention is a cap which includes an inner cap (11) and an outer cap (12), in which the inner cap (11) is formed in a topped cylindrical shape in which it has an inner peripheral wall (21) and an inner top wall (22), the outer cap (12) is formed in a topped cylindrical shape in which it has an outer peripheral wall (23) and an outer top wall (24), the outer peripheral wall (23) includes an inner cylinder (25) and an outer cylinder (26), a plurality of elastic projection pieces (27) are provided at intervals in a circumferential direction at a lower end opening edge of the inner cylinder (25), and the plurality of elastic projection pieces (27) include first elastic projection pieces (27A) in which support protrusions (28) are formed at lower ends.

2 Claims, 3 Drawing Sheets

(56) References Cited

U.S. PATENT DOCUMENTS

| | | | | |
|---|---|---|---|---|
| 2023/0174277 | A1* | 6/2023 | Brozell | B65D 41/12 215/277 |
| 2023/0348148 | A1* | 11/2023 | Ritzenhoff | B65D 41/16 |

FOREIGN PATENT DOCUMENTS

| | | | |
|---|---|---|---|
| EP | 3260390 | A1 | 12/2017 |
| JP | S52-028683 | Y2 | 6/1977 |
| JP | S63-042538 | U | 3/1988 |
| JP | H05-26848 | U | 4/1993 |
| JP | H06-067350 | U | 9/1994 |
| JP | 2018193088 | A * | 12/2018 |
| JP | 2019-001539 | A | 1/2019 |
| KR | 20-2012-0001224 | U | 2/2012 |

OTHER PUBLICATIONS

May 18, 2026 Office Action issued in Chinese Patent Application No. 202480006149.2 (English Search Report attached).

Jingyun Han, "Overview of Patent Technology for Child Safety Covers", Management and Technology of Small and Medium-sized Enterprises (first ten-day issue), Issue 7, Jul. 5, 2016, pp. 91-92. (Concise English-language statement of relevance provided in NPL Cite 2).

Jul. 15, 2026 Office Action issued in Chinese Patent Application No. 202480006149.2.

* cited by examiner

CAP

TECHNICAL FIELD

The present invention relates to a cap.

Priority is claimed on Japanese Patent Application No. 2023-006556, filed Jan. 19, 2023, the content of which is incorporated herein by reference.

BACKGROUND ART

In the related art, for example, caps as shown in Patent Document 1 which will be described below are known.

CITATION LIST

Patent Document

Patent Document 1: Japanese Unexamined Utility Model Application, First Publication No. S63-42538

SUMMARY OF INVENTION

Technical Problem

There is room for improvement in easily forming a cap so that it includes, for example, new functions such as decorativeness and gripping ability.

The present invention provides a cap in which new functions can easily be provided in the cap.

Solution to Problem

A first aspect of the present invention is a cap including: an inner cap which is installed in a mouth portion of a container body that accommodates contents; and an outer cap which is installed in the inner cap in a state in which relative movement thereof is restricted, in which the inner cap is formed in a topped cylindrical shape in which it has an inner peripheral wall and an inner top wall, the outer cap is formed in a topped cylindrical shape in which it has an outer peripheral wall and an outer top wall, the outer peripheral wall includes an inner cylinder which is externally fitted onto the inner peripheral wall, and an outer cylinder which surrounds the inner cylinder from an outside in a radial direction, a plurality of elastic projection pieces which protrude downward and are formed to be elastically deformable in the radial direction are provided at intervals in a circumferential direction at a lower end opening edge of the inner cylinder, lower ends of the plurality of elastic projection pieces are positioned above a lower end opening edge of the outer cylinder and below a lower end opening edge of the inner peripheral wall, and the plurality of elastic projection pieces include first elastic projection pieces in which support protrusions protruding inward in the radial direction and configured to support the lower end opening edge of the inner peripheral wall are formed in lower ends.

In this case, the elastic projection pieces are provided on the inner cylinder of the outer peripheral wall of the outer cap, and support protrusions which support the lower end opening edge of the inner peripheral wall of the inner cap are formed on the elastic projection pieces. Thus, when the outer cap is installed in the inner cap, if the outer cap is placed over the inner cap and pressed down, the support protrusions slide against the outer peripheral surface of the inner peripheral wall in a state in which the elastic projection pieces are elastically deformed outward in the radial direction. Furthermore, when the support protrusions reach the lower end opening edge of the inner peripheral wall, the elastic projection pieces undergo restoration deformation toward the inside in the radial direction, and the support protrusions support the lower end opening edge of the inner peripheral wall.

Therefore, it is possible to easily install the outer cap which includes, for example, functions such as decorativeness and gripping ability in the inner cap, and it is possible to easily provide a new function in the cap.

Also, the lower ends of the elastic projection pieces are located above the lower end opening edge of the outer cylinder. Thus, it is possible to prevent deterioration of the appearance of the cap by covering the entire region of the elastic projection pieces with the outer cylinder from the outside in the radial direction.

A second aspect of the present invention is the cap according to the first aspect in which a first restriction part is formed on an inner peripheral surface of the inner cylinder, a second restriction part is formed on an outer peripheral surface of the inner peripheral wall, the first restriction part and the second restriction part are configured to engage with each other and restrict relative rotation of the outer cap and the inner cap, the plurality of elastic projection pieces are four or more even numbers of elastic projection pieces, each of the four or more even numbers of elastic projection pieces being provided at a position at which one elastic projection piece is opposite to another elastic projection piece in the radial direction, two or more even numbers of elastic projection pieces of the four or more even numbers of elastic projection pieces form the first elastic projection pieces, each of the two or more even numbers of elastic projection pieces being provided at a position at which one elastic projection piece is opposite to another elastic projection piece in the radial direction, and the first restriction part is provided at a position which are spaced apart from the first elastic projection pieces in the circumferential direction, on the inner peripheral surface of the inner cylinder.

In this case, the first restriction parts are provided at positions on the inner peripheral surface of the inner cylinder which are spaced apart in the circumferential direction from the elastic projection pieces on which the support protrusions are formed. Thus, when the outer cap is installed in the inner cap, as the support protrusions slide against the outer peripheral surface of the inner peripheral wall, it is possible to prevent the first restriction parts from being deformed due to the elastic deformation of the elastic projection pieces, and it is possible to reliably engage the first restriction parts and the second restriction parts with each other.

Furthermore, the support protrusions are formed separately on the elastic projection pieces which are opposite to each other in the radial direction. Thus, it is possible to stably install the outer cap in the inner cap.

Advantageous Effects of Invention

According to the present invention, it is possible to easily provide new functions in a cap.

DESCRIPTION OF EMBODIMENTS

An embodiment of the present invention will be described below with reference to the drawings.

Figure 1:
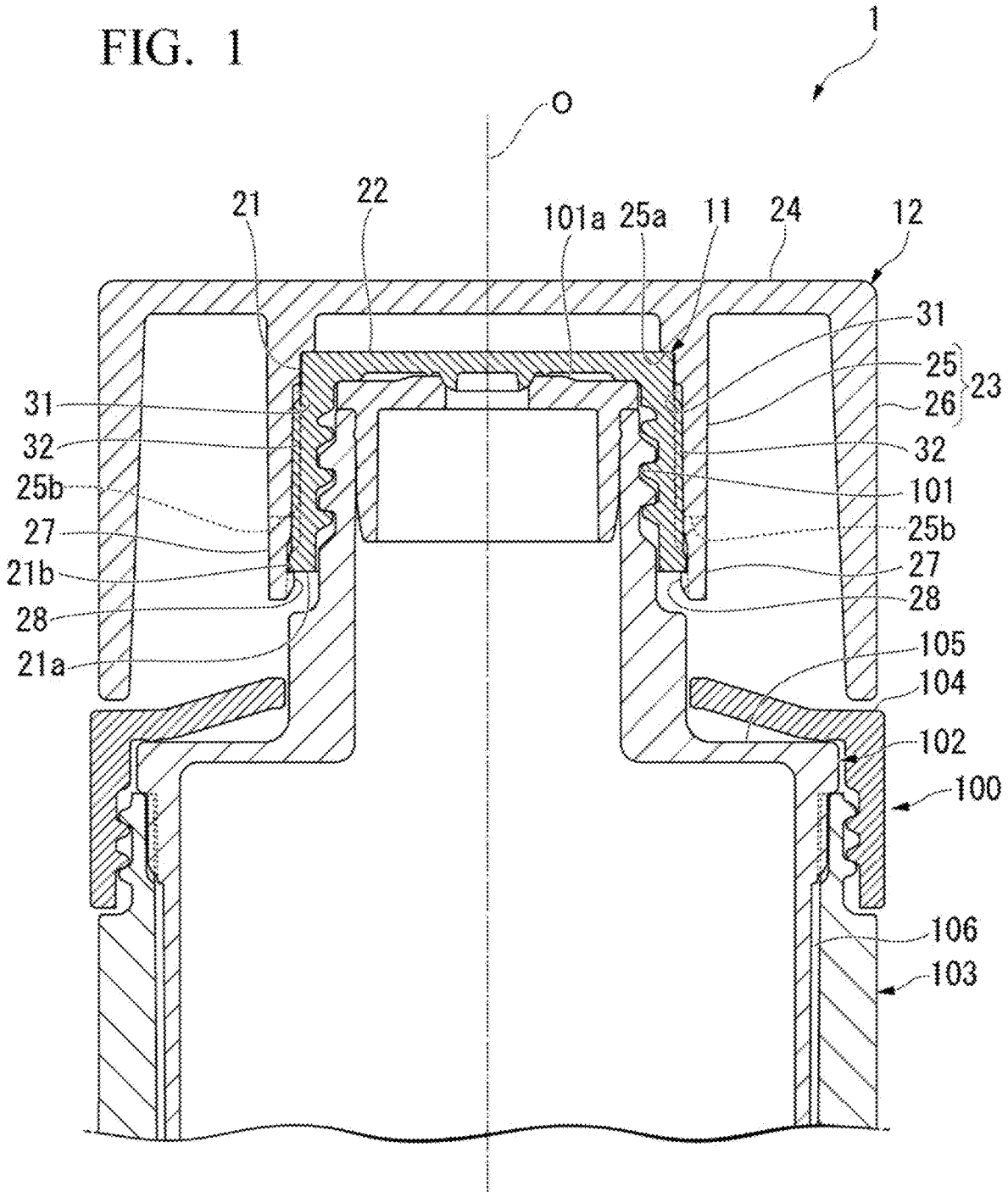
FIG. 1 A vertical cross-sectional view of a cap according to an embodiment of the present invention.
Figure 2:
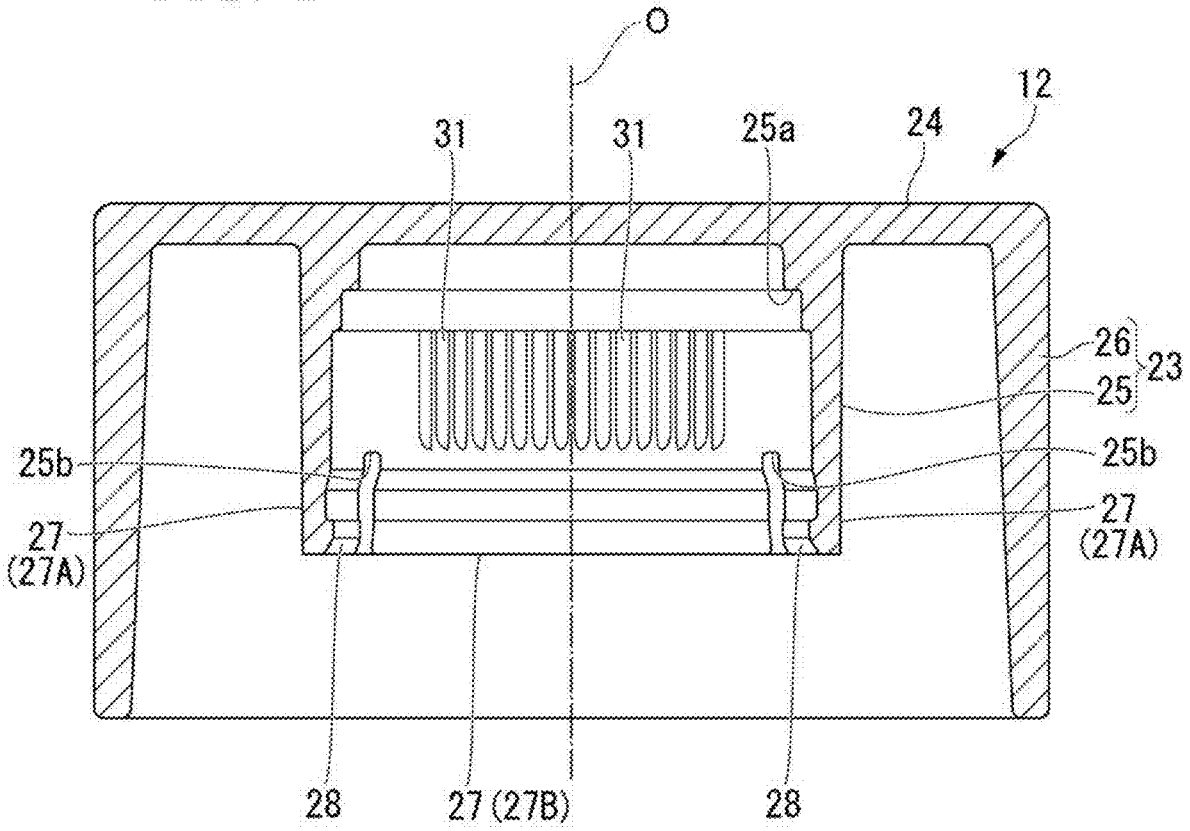
FIG. 2 A vertical cross-sectional view of an outer cap of FIG. 1 when first restriction parts are viewed from a front thereof.
Figure 3:
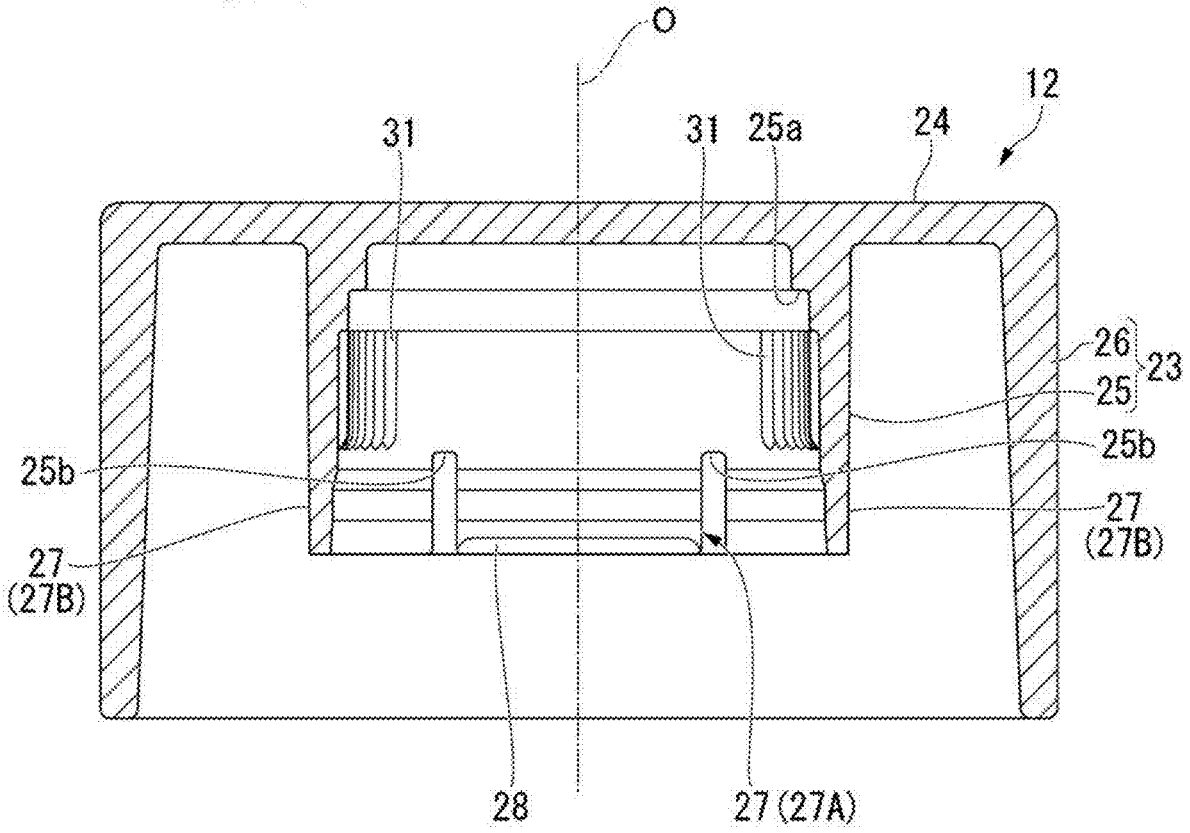
FIG. 3 A vertical cross-sectional view of an outer cap in FIG. 1 when a support protrusion is viewed from a front thereof.

As shown in FIG. 1, a cap 1 in an embodiment includes an inner cap 11 which is installed in a mouth portion 101 of a container body 100 that accommodates contents, and an outer cap 12 which is installed in the inner cap 11 in a state that the relative movement thereof is restricted.

The inner cap 11 is formed in a topped cylindrical shape in which it has an inner peripheral wall 21 and an inner top wall 22, and the outer cap 12 is formed in a topped cylindrical shape in which it has an outer peripheral wall 23 and an outer top wall 24. The inner cap 11 and the outer cap 12 are arranged coaxially on a common axis.

Hereinafter, the common axis is referred to as a cap axis O, a side of the outer top wall 24 in a direction of the cap axis O is referred to as an upper side, a side opposite thereto is referred to as a lower side, a direction along the cap axis O is referred to as an upward/downward direction, a direction which intersects the cap axis O when viewed from the upward/downward direction is referred to as a radial direction, and a direction which goes around the cap axis O when viewed from the upward/downward direction is referred to as a circumferential direction.

The container body 100 includes an inner container 102, an outer container 103, and a shoulder cover 104.

The inner container 102 accommodates contents. The inner container 102 is formed in a bottomed cylindrical shape and is formed by connecting the mouth portion 101, a shoulder portion 105, and a body 106 in this order from above to below. A topped cylindrical inner plug 101*a* having an annular top wall is fitted into the mouth portion 101.

The outer container 103 is formed in a bottomed cylindrical shape and surrounds the body 106 of the inner container 102 from the outside in the radial direction. The mouth portion 101 and the shoulder portion 105 of the inner container 102 protrude upward from an upper opening of the outer container 103.

The shoulder cover 104 is formed in a topped cylindrical shape in which it has an annular top wall, is screwed to an upper end of the outer container 103, and covers the shoulder portion 105 of the inner container 102 from above the shoulder portion 105. The mouth portion 101 protrudes upward from the inside of a top wall of the shoulder cover 104.

The container body 100 may not have the inner plug 101*a*, the outer container 103, and the shoulder cover 104.

A female thread which is screwed into a male thread formed on outer peripheral surface of the mouth portion 101 is formed in an inner peripheral surface of the inner peripheral wall 21 of the inner cap 11. A protrusion 21*b* which protrudes outward in the radial direction and extends continuously over the entire length in the circumferential direction is formed at a lower end of the inner peripheral wall 21 of the inner cap 11.

The outer peripheral wall 23 of the outer cap 12 includes an inner cylinder 25 which is externally fitted onto the inner peripheral wall 21 of the inner cap 11 and an outer cylinder 26 which surrounds the inner cylinder 25 from the outside in the radial direction.

An outer diameter of the outer cylinder 26 is the same as outer diameters of the outer container 103 and the shoulder cover 104. A lower end opening edge of the outer cylinder 26 is in contact with or is close to an upper surface of the top wall of the shoulder cover 104.

A step 25*a* which is directed downward and in contact with or close to an outer circumferential edge on an upper surface of the inner top wall 22 of the inner cap 11 is formed on an inner peripheral surface of an upper end of the inner cylinder 25. The upper surface of the inner top wall 22 is away downward from a lower surface of the outer top wall 24 of the outer cap 12.

A plurality of elastic projection pieces 27 (first elastic projection pieces 27A and second elastic projection piece 27B) which protrude downward and are formed to be elastically deformable in the radial direction are provided at intervals in the circumferential direction at lower end opening edges 25*b* of the inner cylinder 25. The elastic projection pieces 27 (first elastic projection pieces 27A and second elastic projection pieces 27B) are formed in a plate shape in which the front and rear surfaces thereof are directed in the radial direction. The elastic projection pieces 27 (first elastic projection pieces 27A and second elastic projection piece 27B) are curved and extend in the circumferential direction. Four or more even numbers of the elastic projection pieces 27 (the first elastic projection pieces 27A and the second elastic projection piece 27B) are provided at positions opposite the other elastic projection pieces 27 in the radial direction. Lower ends of the elastic projection pieces 27 are positioned above the lower end opening edge of the outer cylinder 26 and below a lower end opening edge 21*a* of the inner peripheral wall 21.

Support protrusions 28 which protrude inward in the radial direction and support the lower end opening edge 21*a* of the inner peripheral wall 21 are formed at the lower ends of the elastic projection pieces 27 (first elastic projection pieces 27A). The support protrusions 28 are formed separately on the elastic projection pieces 27 (first elastic projection pieces 27A) which face each other in the radial direction. The support protrusions 28 are formed in a strip shape in which they extend in the circumferential direction. The support protrusions 28 extend continuously over the entire length in the circumferential direction of the elastic projection pieces 27 (first elastic projection pieces 27A). The lower portions of the support protrusions 28 extend inward in the radial direction from the bottom to the top. The support protrusion 28 have upper end surfaces which protrude inward in the radial direction from inner peripheral surfaces directed in ward in the radial direction of the elastic projection pieces 27 (first elastic projection pieces 27A) and are directed upward. The upper end surfaces of the support protrusions 28 are in contact with or close to the lower end opening edge 21*a* of the inner peripheral wall 21. The upper end surfaces of the support protrusions 28 and the step 25*a* of the inner peripheral surface of the inner cylinder 25 sandwich the inner cap 11 in the upward/downward direction, thereby restricting the relative movement in the upward/downward direction of the inner cap 11 and the outer cap 12. For this reason, the inner cap 11 is prevented from being removed from the outer cap 12, and the cap 1 in which the inner cap 11 and the outer cap 12 are combined can be used repeatedly. The inner cap 11 may be removed from the outer cap 12, and a new inner cap may be fitted into the outer cap 12. The plurality of elastic projection pieces 27 include the elastic projection pieces 27 (first elastic projection pieces 27A) in which the support protrusions 28 protruding inward in the radial direction and configured to support the lower end opening edge 21*a* of the inner peripheral wall 21 are formed in lower ends. Furthermore, the plurality of elastic projection pieces 27 include the elastic projection pieces 27 (second elastic projection pieces 27B) in which the support protrusions 28 are not formed.

First restriction parts 31 and second restriction parts 32 which engage with each other and restrict the relative rotation of the outer cap 12 and the inner cap 11 are formed separately on the inner peripheral surface of the inner cylinder 25 and the outer peripheral surface of the inner peripheral wall 21.

A plurality of first restriction parts 31 and a plurality of second restriction parts 32 are each provided in the circumferential direction. The first restriction parts 31 and the second restriction parts 32 are formed in a ridge shape in which they protrude in the radial direction and extend in the upward/downward direction. One restriction parts of the first restriction parts 31 and the second restriction parts 32 are inserted between the other restriction parts adjacent to each other in the circumferential direction. The first restriction parts 31 are provided on a portion of the inner peripheral surface of the inner cylinder 25 which is located below the step 25*a*. The first restriction parts 31 are located above the elastic projection pieces 27 (first elastic projection pieces 27A and second elastic projection piece 27B).

The first restriction parts 31 and the support protrusions 28 are provided at positions which are spaced apart in the circumferential direction. The first restriction parts 31 are provided at positions on the inner peripheral surface of the inner cylinder 25 which are spaced apart in the circumferential direction from the elastic projection pieces 27 (first elastic projection pieces 27A) on which the support protrusions 28 are formed. The first restriction parts 31 are provided in the circumferential direction on a plurality of parts of the inner peripheral surface of the inner cylinder 25 which are opposite to each other in the radial direction. Of the plurality of elastic projection pieces 27 (first elastic projection pieces 27A and second elastic projection piece 27B), a size in the circumferential direction of the elastic projection pieces 27 (first elastic projection pieces 27A) on which the support protrusions 28 are formed is smaller than a size in the circumferential direction of the elastic projection piece 27 (second elastic projection piece 27B) which is located directly below the first restriction parts 31.

As explained above, according to the cap 1 relating to the embodiment, the elastic projection pieces 27 (first elastic projection pieces 27A and second elastic projection piece 27B) are provided on the outer peripheral wall 23 of the outer cap 12, and the support protrusions 28 which support the lower end opening edge 21*a* of the inner peripheral wall 21 of the inner cap 11 are formed on the elastic projection pieces 27 (first elastic projection pieces 27A). Thus, when the outer cap 12 is installed in the inner cap 11, if the outer cap 12 is placed over the inner cap 11 and pressed down, the support protrusions 28 slide against the outer peripheral surface of the inner peripheral wall 21 in a state in which the elastic projection pieces 27 (first elastic projection pieces 27A) are elastically deformed outward in the radial direction. Furthermore, when the support protrusions 28 reach the lower end opening edge 21*a* of the inner peripheral wall 21, the elastic projection pieces 27 (first elastic projection pieces 27A) undergo restoration deformation toward the inside in the radial direction, and the support protrusions 28 support the lower end opening edge 21*a* of the inner peripheral wall 21.

Therefore, it is possible to easily install the outer cap 12 which includes, for example, functions such as decorativeness and gripping ability in the inner cap 11, and it is possible to easily provide a new function in the cap 1.

Also, the lower ends of the elastic projection pieces 27 (first elastic projection pieces 27A and second elastic projection piece 27B) are located above the lower end opening edge of the outer cylinder 26. Thus, it is possible to prevent deterioration of the appearance of the cap 1 by covering the entire region of the elastic projection pieces 27 (first elastic projection pieces 27A and second elastic projection pieces 27B) with the outer cylinder 26 from the outside in the radial direction.

Moreover, the first restriction parts 31 are provided at positions on the inner peripheral surface of the inner cylinder 25 which are spaced apart in the circumferential direction from the elastic projection pieces 27 (first elastic projection pieces 27A) on which the support protrusions 28 are formed. Thus, when the outer cap 12 is installed in the inner cap 11, as the support protrusions 28 slide against the outer peripheral surface of the inner peripheral wall 21, it is possible to prevent the first restriction parts 31 from being deformed due to the elastic deformation of the elastic projection pieces 27 (first elastic projection pieces 27A), and it is possible to reliably engage the first restriction parts 31 and the second restriction parts 32 with each other.

Furthermore, the support protrusions 28 are formed separately on the elastic projection pieces 27 which are opposite to each other in the radial direction. Thus, it is possible to stably install the outer cap 12 in the inner cap 11.

The technical scope of the present invention is not limited to the above-described embodiment and various modifications can be made without departing from the spirit of the present invention.

For example, the cap 1 in which the inner cap 11 and the outer cap 12 are combined may be installed in the mouth portion 101 of the container body 100, and the outer cap 12 may be installed in the inner cap 11 which is installed in the mouth portion 101 of the container body 100.

In addition, the constituent elements in the above-described embodiment may be replaced with known constituent elements as appropriate and the above-described embodiment and modified examples may be combined as appropriate without departing from the spirit of the present invention.

Aspects of the present invention are, for example, as follows.

(1) A cap includes an inner cap which is installed in a mouth portion of a container body that accommodates contents, and an outer cap which is installed in the inner cap in a state in which relative movement thereof is restricted, in which the inner cap is formed in a topped cylindrical shape in which it has an inner peripheral wall and an inner top wall, the outer cap is formed in a topped cylindrical shape in which it has an outer peripheral wall and an outer top wall, the outer peripheral wall includes an inner cylinder which is externally fitted onto the inner peripheral wall, and an outer cylinder which surrounds the inner cylinder from the outside in a radial direction, a plurality of elastic projection pieces which protrude downward and are formed to be elastically deformable in the radial direction are provided at intervals in a circumferential direction at a lower end opening edge of the inner cylinder, lower ends of the plurality of elastic projection pieces are positioned above a lower end opening edge of the outer cylinder and below a lower end opening edge of the inner peripheral wall, and the plurality of elastic projection pieces include first elastic projection pieces in which support protrusions protruding inward in the radial direction and configured to support the lower end opening edge of the inner peripheral wall are formed in lower ends.

(2) In the cap according to (1), a first restriction part is formed on an inner peripheral surface of the inner cylinder, a second restriction part is formed on an outer peripheral surface of the inner peripheral wall, the first restriction part and the second restriction part are configured to engage with each other and restrict relative rotation of the outer cap and the inner cap, the plurality of elastic projection pieces are four or more even numbers of elastic projection pieces, each of the four or more even numbers of elastic projection pieces being provided at a position at which one elastic projection piece is opposite to another elastic projection piece in the radial direction, two or more even numbers of elastic projection pieces of the four or more even numbers of elastic projection pieces form the first elastic projection pieces, each of the two or more even numbers of elastic projection pieces being provided at a position at which one elastic projection piece is opposite to another in the radial direction, and the first restriction part is provided at a position which is spaced apart from the first elastic projection pieces in the circumferential direction, on the inner peripheral surface of the inner cylinders.

INDUSTRIAL APPLICABILITY

According to the present invention, it is possible to easily provide new functions in a cap.

REFERENCE SIGNS LIST

1 Cap
11 Inner cap
12 Outer cap
21 Inner peripheral wall
21*a* Lower end opening edge of inner peripheral wall
22 Inner top wall
23 Outer peripheral wall
24 Outer top wall
25 Inner cylinder
25*b* Lower end opening edge of inner cylinder
26 Outer cylinder
27 Elastic projection piece
27A First elastic projection piece
27B Second elastic projection piece
28 Support protrusion
31 First restriction part
32 Second restriction part
100 Container body
101 Mouth portion

The invention claimed is:

1. A cap comprising:

an inner cap configured to be installed on a mouth portion of a container body that accommodates contents; and an outer cap which is installed on the inner cap in a state in which relative movement thereof is restricted, wherein the inner cap is formed in a topped cylindrical shape in which it has an inner peripheral wall and an inner top wall, the outer cap is formed in a topped cylindrical shape in which it has an outer peripheral wall and an outer top wall, the outer peripheral wall includes an inner cylinder which is externally fitted onto the inner peripheral wall, and an outer cylinder which surrounds the inner cylinder from an outside in a radial direction, a plurality of elastic projection pieces which protrude downward and are formed to be elastically deformable in the radial direction, are provided at intervals in a circumferential direction at a lower end opening edge of the inner cylinder, lower ends of the plurality of elastic projection pieces are positioned above a lower end opening edge of the outer cylinder and below a lower end opening edge of the inner peripheral wall, and the plurality of elastic projection pieces include first elastic projection pieces in which support protrusions protruding inward in the radial direction and configured to support the lower end opening edge of the inner peripheral wall are formed in lower ends, and second elastic projection pieces in which the support protrusions are not formed.

2. The cap according to claim 1, wherein a first restriction part is formed on an inner peripheral surface of the inner cylinder, a second restriction part is formed on an outer peripheral surface of the inner peripheral wall, the first restriction part and the second restriction part are configured to engage with each other and restrict relative rotation of the outer cap and the inner cap, the plurality of elastic projection pieces are four or more even numbers of elastic projection pieces, each of the four or more even numbers of elastic projection pieces being provided at a position at which one elastic projection piece is opposite to another elastic projection piece in the radial direction, two or more even numbers of elastic projection pieces of the four or more even numbers of elastic projection pieces form the first elastic projection pieces, each of the two or more even numbers of elastic projection pieces being provided at a position at which one elastic projection piece is opposite to another elastic projection piece in the radial direction, and the first restriction part is provided at a position which is spaced apart from the first elastic projection pieces in the circumferential direction, on the inner peripheral surface of the inner cylinder.

* * * * *